US005299281A

United States Patent [19]

Coolegem

[11] Patent Number: 5,299,281

[45] Date of Patent: Mar. 29, 1994

[54] METHOD AND APPARATUS FOR CONVERTING A DIGITAL SPEECH SIGNAL INTO LINEAR PREDICTION CODING PARAMETERS AND CONTROL CODE SIGNALS AND RETRIEVING THE DIGITAL SPEECH SIGNAL THEREFROM

[75] Inventor: Karel G. Coolegem, The Hague, Netherlands

[73] Assignee: Koninklijke PTT Nederland N.V., Groningen, Netherlands

[21] Appl. No.: 974,361

[22] Filed: Nov. 6, 1992

Related U.S. Application Data

[63] Continuation of Ser. No. 580,866, Sep. 11, 1990, abandoned.

[30] Foreign Application Priority Data

Sep. 20, 1989 [NL] Netherlands ..... 8902347

[51] Int. Cl.[5] ..... G10L 9/02

[52] U.S. Cl. ..... 395/2.28

[58] Field of Search ..... 381/29-40, 381/51; 395/2.28

[56] References Cited

U.S. PATENT DOCUMENTS

| | | | |
|---|---|---|---|
| Re. 32,580 | 1/1988 | Atal et al. | 381/40 |
| 4,701,954 | 10/1987 | Atal | 381/49 |
| 4,860,355 | 8/1989 | Copperi | 381/36 |
| 4,864,621 | 9/1989 | Boyd | 381/38 |
| 4,932,061 | 6/1990 | Kroon et al. | 381/30 |

FOREIGN PATENT DOCUMENTS

| | | |
|---|---|---|
| 0232456 | 8/1987 | European Pat. Off. . |
| 0307122 | 3/1989 | European Pat. Off. . |
| 0195487 | 6/1989 | European Pat. Off. . |

OTHER PUBLICATIONS

Frequenz, vol. 42, Feb.-Mar. 1988, pp. 85-93, "Speech Codec for the European Mobile Radio System".

ICASSP 86, NTT Electrical Communications Laboratories, pp. 1697-1700, Iai et al., "8 kbits/S Speech coder with Path Adaptive Vector Quantizer".

ICASSP 86, "On the Behaviour of Reduced Complexity Code-Excited Linear Prediction (CELP)", pp. 469-472, Hernandez-Gomez et al., Mar. 1986.

ICASSP 87, "Speech Coding Using Efficient Pseudo-Stochastic . . . " pp. 1354-1357, Daniel Lin, Feb. 1987.

*Primary Examiner*—Michael R. Fleming
*Assistant Examiner*—Michelle Doerrler
*Attorney, Agent, or Firm*—Frishauf, Holtz, Goodman & Woodward

[57] ABSTRACT

Analog speech signals are coded as digital signals before transmission over a transmission medium and then are decoded at their destination. The coder is of the linear predictive type (LPC) and includes an LPC analyzer for adjusting an analysis filter, which receives the digital signal and generates a residual signal representative of error content. The parameters by which the filter is adjusted by the analyzer and the residual signal together represent the digital signal. The residual signal is split into segments and, per segment, several first pulse train signals are generated, each having a different starting time position within the segment. The first pulse train signal which is most closely related to the residual signal is selected and compared to second pulse train signals stored in a codebook. A location in the codebook belonging to a second pulse train signal that exhibits the greatest degree of correspondence to the selected first pulse train signal and the starting position of the selected first pulse train signal, together, represent the residual signal and are transmitted into and through the transmission medium in addition to the LPC parameters. At the receiving location a synthesizer filter is controlled by a modified output of a duplicate codebook.

14 Claims, 3 Drawing Sheets

METHOD AND APPARATUS FOR CONVERTING A DIGITAL SPEECH SIGNAL INTO LINEAR PREDICTION CODING PARAMETERS AND CONTROL CODE SIGNALS AND RETRIEVING THE DIGITAL SPEECH SIGNAL THEREFROM

This application is a continuation of application Ser. No. 07/580,866, filed Sep. 11, 1990 now abandoned.

BACKGROUND OF THE INVENTION

The invention relates to a method for coding an analog signal occurring with a certain time interval, said analog signal being converted into control codes which can be used for assembling a synthetic signal corresponding to said analog signal. The invention also relates to an apparatus for carrying out such a method. In particular, the invention relates to a method and apparatus for coding speech signals as digital signals having a low bit frequency.

Such a method or apparatus is disclosed by EP-307,122. According to the known method, an analog (speech) signal (after linear predictive coding (LPC)) is successively converted into a pulse signal composed of pulses at equal (time) spacing from one another, the amplitude of said pulses corresponding to the respective instantaneous amplitudes of the analog signal. A series of p second pulse signals is then generated, all of which are composed of only one pulse, of which, however, the position (in the time domain) of said pulse successively increases with respect to the start of the second pulse signal according to the series based on n times the time spacing of the first pulse signal, where $n=0 \ldots p$. Of said second pulse signals, that pulse signal is then selected which approximates best to the first pulse signal. The first pulse signal is then compared with a set of various third pulse signals, all composed of a number of pulses at mutually different spacings and having mutually different amplitudes, but all of which belong to one and the same class and of which the position of the most significant pulse corresponds to the position of the selected second pulse signal. From this set, that third pulse signal is then selected which corresponds most to the first pulse signal. According to the known method, the set of third pulse signals forms part of a group of such sets, each set having its own class as regards the position of the most significant pulse. By selecting the best second (one-) pulse signal, that set (=class) is therefore indicated which has to be searched for correspondence to the first pulse signal. After selecting the most corresponding third pulse signal, the characteristics of said third pulse signal are used as a control code for assembling a synthetic signal corresponding to said analog signal. In the proposed manner, only a limited set of third pulse signals has to be searched for correspondence, instead of all the third pulse signals of all the sets; in other words, only a part (characterized by the relevant class) of a large set has to be searched instead of said set in its entirety.

A drawback of the known method is that it does not fit in with the present GSM (Grouppe Spéciale Mobile) practice.

SUMMARY OF THE INVENTION

The object of the invention is to provide an alternative to the known method or apparatus which is in fact compatible with the GSM system.

The invention therefore provides a method for coding an analog signal occurring within a certain time interval, said analog signal being converted into control codes which can be used for assembling a synthetic signal corresponding to said analog signal, which method is characterized in that the analog signal is converted into a first pulse signal composed of pulses at a mutually equal time interval, the pulse amplitude of said pulses corresponding to that of the analog signal at that instant;

in that the first pulse signal is converted into a series of p second pulse signals which are each likewise composed of a fixed number of pulses at a mutually equal time spacing which is, however, a multiple of that of the first pulse signal, while the pulse amplitude likewise corresponds to that of the analog signal at that instant, in which connection, of the successive second pulse signals of said series, the position of the first pulse of the respective second pulse signal, viewed in the time domain, is shifted in time with respect to the start thereof over a spacing equal to a multiple n of the said time spacing of the first pulse signal, n successively increasing from 0 to p;

in that that second pulse signal whose correspondence to the first pulse signal is the greatest is selected from the various second pulse signals and in that a first control code for assembling the synthetic signal corresponding to the analog signal is generated in accordance with the time spacing between the start and the first pulse of said selected second pulse signal;

in that the said first pulse signal is compared with a set of various third pulse signals which are each composed of pulses at a mutually equal time spacing equal to that of the second pulse signals, which pulses have various pulse amplitudes and in which connection, of all said third pulse signals, the position of the first pulse of the respective third pulse signal, viewed in the time domain, is shifted in time with respect to the start thereof over a spacing which is equal to that of the selected second pulse signal;

in that that third pulse signal whose correspondence to the first pulse signal is the greatest is selected from the said set and in that a second control code for assembling the synthetic signal corresponding to the analog signal is generated in accordance with the order number of said selected third pulse signal.

Instead of the first pulse signal being compared with the various third pulse signals of the said set (after which that third pulse signal whose correspondence to said first pulse signal is the greatest is selected from said set) it is also possible (and preferable), for the (previously) selected second pulse signal to be compared with the various third pulse signals, after which that third pulse signal whose correspondence to the selected second pulse signal is the greatest, is selected.

In relation to the above measures, it is pointed out that converting the first pulse signal into a series of second pulse signals of the specified type is disclosed per se in EP-195,487. According to the method and apparatus described therein, however, no use is made of a set of third pulse signals of the specified type with which the first pulse signal or the previously selected second pulse signal is compared and from which a corresponding third pulse signal is selected, as is in fact the case according to the invention.

A further development of the invention may provide that the said set of third signals forms part of a group of such sets, each of said sets, like the set already mentioned, comprising mutually different pulse signals which are composed of pulses at a mutually equal time spacing which is equal to that of the said second pulse signals and having different pulse amplitudes, for each set the position of the first pulse of all those pulse signals, viewed in time, being identical with respect to the start thereof;

that, after the previously mentioned selection of the second pulse signal which corresponds most to the first pulse signal, that set whose position of the first pulse of the pulse signals with respect to the start thereof, viewed in time, is identical to that of the selected second pulse signal is selected from the said group of sets. In other words, the said set of third pulse signals is in fact a part of a greater set, but only that part (the most relevant) is searched for correspondence to the first pulse signal or the previously selected second pulse signal.

Preferably, however, a further development of the invention provides that the said set of third pulse signals is a virtual set which is generated from a basic set of mutually different fourth pulse signals, each being composed of pulses at a mutually equal time spacing equal to that of the second pulse signals, which pulses have various pulse amplitudes and in which connection, of all said fourth pulse signals, the position of the first pulse, viewed in the time domain, is identical with respect to the position of the start of said fourth pulse signal;

that after the previously mentioned selection of the second pulse signal which corresponds most to the first pulse signal, the said virtual set of third pulse signals is generated by shifting each of the said fourth pulse signals in time over a spacing which is equal to the difference between, on the one hand, the spacing between the start and the first pulse of the selected second pulse signal and, on the other hand, the spacing between the start and the first pulse of each of the fourth pulse signals. According to this further development, only a (limited) basic set of (fourth) pulse signals is therefore provided from which (by shifting the pulse signals) the required "search" set is derived.

In particular, the above is provided in that the said set of third pulse signals is a virtual set which is generated from a basic set of mutually different fourth pulse signals, each being composed of pulses at a mutually equal time spacing equal to that of the second pulse signals, which pulses have various pulse amplitudes and in which connection, of all said fourth pulse signals, the position of the first pulse, viewed in the time domain, corresponds to the position of the start of said fourth pulse signal;

that, after the previously mentioned selection of the second pulse signal which corresponds most to the first pulse signal, the said virtual set of third pulse signals is generated by shifting each of the said fourth pulse signals in time over a spacing which is equal to the spacing between the start and the first pulse of the selected second pulse signal. The shifting of the fourth pulse signals is in this case therefore equal to the time difference between the start and the first pulse of the previously selected second pulse signal.

The method according to the invention is moreover preferably characterized in that, in the said comparison of the first pulse signal or the selected second pulse signal with the various third pulse signals from the said set and the selection of the required third pulse signal as mentioned, a scaling factor is derived from the respective amplitudes of the pulse signals compared with one another and in that a third control code is generated for assembling the synthetic signal corresponding to the analog signal in accordance with that scaling factor which is associated with the selected third pulse signal.

An apparatus for carrying out the first mentioned method according to the invention is characterized by a first conversion device for converting the said analog signal into the said first pulse signal;

a second conversion device for converting the first pulse signal into the said series of p second pulse signals of which the time spacing between the start of the pulse signal and the first pulse is successively 0 to p times the mutual pulse spacing of the first pulse signal, first selection device for selecting the second pulse signal which exhibits the most correspondence to the first pulse signal and for delivering a first control code for assembling the synthetic signal corresponding to the analog signal in accordance with the time spacing between the start and the first pulse of the selected second pulse signal, a second selection device for selecting, from the said set of third pulse signals, that third pulse signal which exhibits the most correspondence to the first pulse signal and for delivering a second control code for assembling the synthetic signal corresponding to the analog signal in accordance with the order number of said selected third pulse signal.

If in selecting the required third pulse signal the various third pulse signals are compared not with the first pulse signal but with the previously selected second pulse signal and examined for correspondence, an apparatus for carrying out the method is characterized by a first conversion device for converting the said analog signal into the said first pulse signal;

a second conversion device for converting the first pulse signal into the said series of p second pulse signals of which the time spacing between the start of the pulse signal and the first pulse is successively 0 to p times the mutual pulse spacing of the first pulse signal, a first selection device for selecting the second pulse signal which exhibits most correspondence to the first pulse signal and for delivering a first control code for assembling the synthetic signal corresponding to the analog signal in accordance with the time spacing between the start and the first pulse of the selected second pulse signal, a second selection device for selecting, from the said set of third pulse signals, that third pulse signal which exhibits the most correspondence to the selected second pulse signal and for delivering a second control code for assembling the synthetic signal corresponding to the analog signal in accordance with the order number of said selected third pulse signal. The apparatus in the exemplary embodiment to be dealt with below is equipped in this way.

If the "search" set forms part of a group of sets from which (according to an option specified above) a choice has to be made, the apparatus is preferably characterized by a third selection device for selecting, from the said group of pulse signal sets, that set of which the time spacing between the start of the pulse signal and the first pulse of all third pulse signals associated with said set is equal to that of the second pulse signal selected by the first selection device.

If (according to a second option) the "search" set is a virtual set which is generated from a basic set by shifting the pulse signals from said basic set, the apparatus is characterized by a generator for generating the said virtual set of third pulse signals from a basic set of fourth pulse signals of the said type. The apparatus in the exemplary embodiment to be dealt with below is equipped in this way, i.e. it is provided with a generator which, from a basic set of (fourth) pulse signals of which the position of the first pulse coincides with the signal start, generates, by signal displacement, a virtual "search" set composed of (third) pulse signals of which the spacing between the start and the first pulse is equal to that of the selected second pulse signal.

An apparatus for carrying out the method according to the invention is preferably characterized by a scaling device for deriving, from the amplitude of the first pulse signal or the second pulse signal selected by the first selection device and the respective amplitudes of the various third pulse signals, respective scaling factors and for delivering a third control code for assembling the synthetic signal corresponding to the analog signal in accordance with that scaling factor which corresponds to the selected third pulse signal.

In particular, an apparatus as specified above is suitable for incorporation in an apparatus for converting analog speech signals into digital signals with a low bit frequency and vice versa, a so-called speech coder/decoder.

In accordance with the methods for coding an analog signal as disclosed above, the invention also includes a method of synthesizing a signal under the control of the said first, second and third control code, characterized in that the synthesized signal is formed by one from a series of fourth pulse signals, being equal to said series of second pulse signals, that fourth pulse signal being selected under the control of said first control signal, which selected fourth pulse signal is combined with one from a set of fifth pulse signals, being equal to said set of third pulse signals, that fifth pulse signal being selected under the control of said second control signal, which selected and combined fourth and fifth pulse signal are scaled up under the control of said third control signal.

In accordance with the apparatuses for coding an analog signal as disclosed above, the invention also includes an apparatus for synthesizing a signal under the control of the first, second and third control code, characterized by

- a third selecting device for selecting from a series of fourth pulse signals, being equal to said series of second pulse signals, one of those fourth pulse signals under the control of said first control signal
- a fourth selecting device for selecting from a set of fifth pulse signals, being equal to said set of third pulse signals, one of those fifth pulse signals under the control of said second control signal, and for combining those selected fourth and fifth pulse signal
- a second scaling device for scaling up those selected and combined fourth and fifth pulse signal under the control of said third control signal.

PUBLICATIONS INCORPORATED BY REFERENCE

EP-307,122 (BRITISH TELECOM)
EP-195,487 (PHILIPS)

DESCRIPTION OF THE PREFERRED EMBODIMENT

Figure 1:
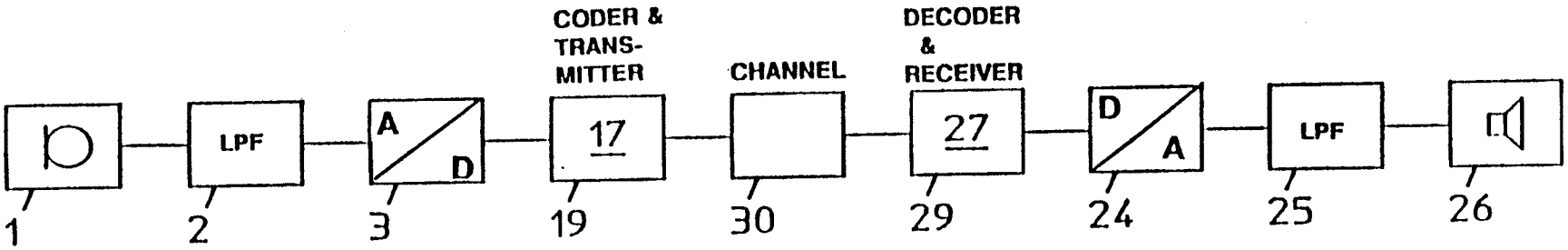
FIG. 1 is a functional-block diagram of a transmission system containing a channel which links a coder and transmitter to a receiver and decoder, in which the method of the invention may be put into practice.
Figure 2:
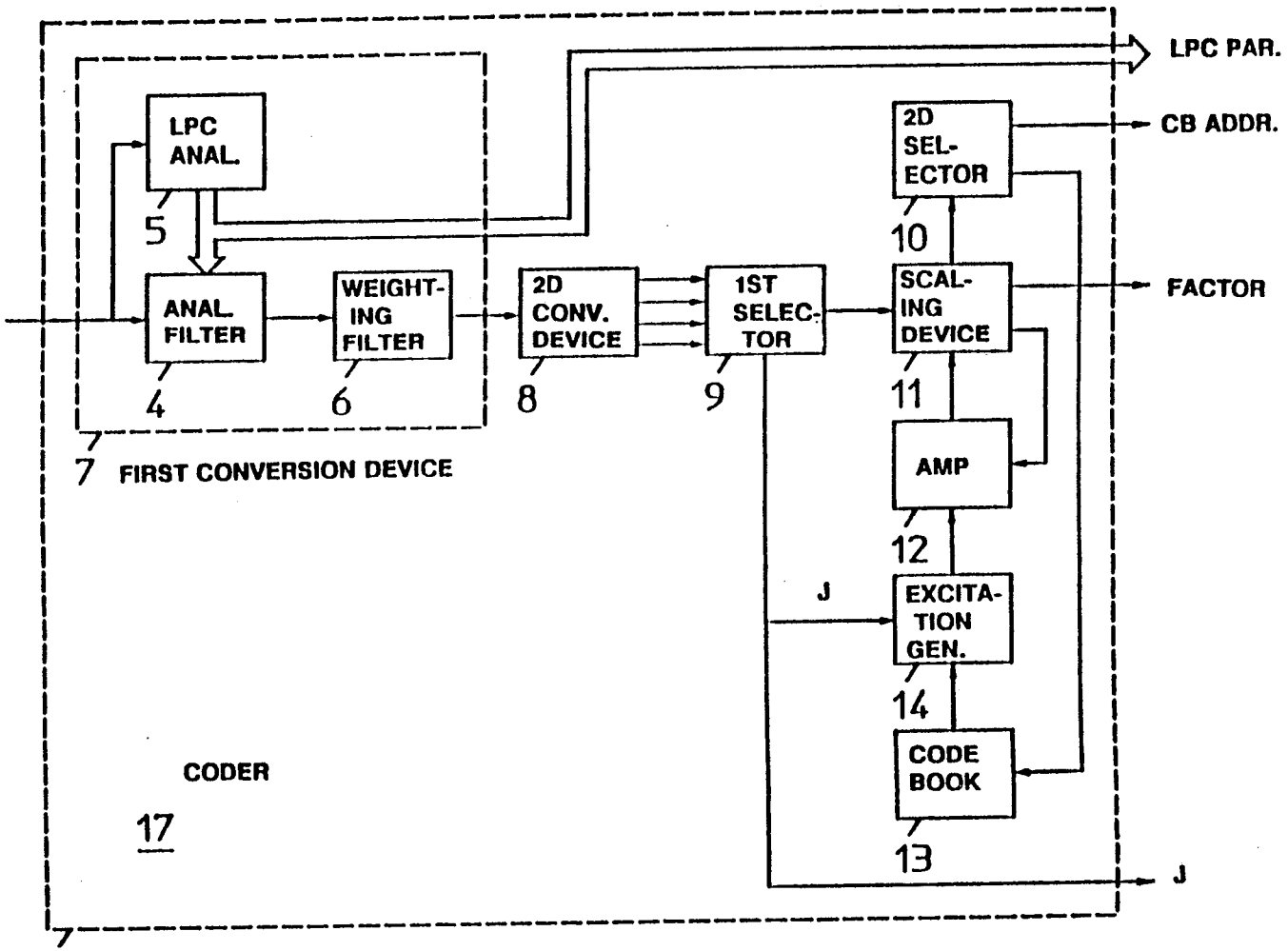
FIG. 2 is a block circuit diagram of the coder of the system shown in FIG. 1.
Figure 3:
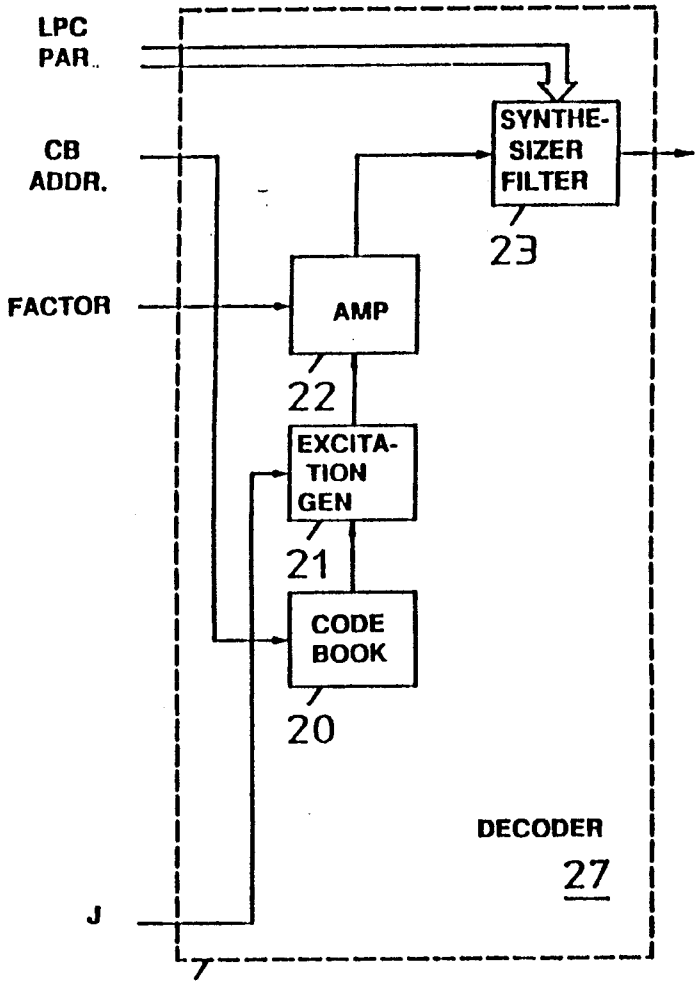
FIG. 3 is a block circuit diagram of the decoder of FIG. 1.

FIGS. 1, 2 and 3 show a functional block diagram for the application of the system described, having a transmitter 19 and a receiver 29 for transmitting a digital speech signal over a channel 30 whose transmission capacity is much lower than the value of 64 kbit/s of a standard PCM channel for telephony. Said digital speech signal represents an analog speech signal originating from a source 1 having a microphone or other electroacoustical transducer and limited to a speech band ranging from 0 to 4 kHz with the aid of a low pass filter 2. Said analog speech signal is sampled with a sampling frequency of 8 kHz and converted into a digital code suitable for use in the transmitter 19 with the aid of an analog/digital converter 3 which also subdivides said digital speech signals into segments of 20 ms (160 samples) which are replaced every 20 ms. In transmitter 19, said digital speech signal is processed to form a code signal having a bit frequency in the region around 6 kbit/s which is transmitted via channel 30 to receiver 29 and is processed therein to form a digital synthetic speech signal which, by means of a digital-analog converter 24, is converted into an analog speech signal which after being limited in a low pass filter 25 is fed to a reproduction circuit 26 having a loudspeaker or another electroacoustical transducer. Transmitter 19 (FIGS. 1 and 2) contains the Restricted Search Code Excited Linear Predictive coder (RSCELP coder) 17 which makes use of linear predictive coding (LPC) as a method of spectral analysis. Since RSCELP coder 17 processes a digital speech signal which is representative of the samples s(kT) of an analog speech signal s(t) at instants in time $t=kT$, where k is an integer and $1/T=8$ kHz, said digital speech signal is denoted by the standard notation of the type s(k). The analog/digital converter 3 subdivides said signal s(k) into segments of 20 ms. Within the qth segment, the signal is denoted by s(n), where $n=1 \ldots 160$. A notation of this type is likewise used for all the other signals in the RSCELP coder 17. In the RSCELP coder 17, the segments of the digital speech signal s(n) are fed to the first conversion device 7 composed of an LPC analyser 5, an analysis assisting inverse filter 4 and a weighting filter 6. The speech signal s(n) is fed to the LPC analyser 5 in which the linear predictive coder LPC parameters of a 20 ms speech segment are calculated every 20 ms in a known manner, for example on the basis of the autocorrelation method or the covariance method of linear prediction (cf. L. R. Rabiner and R. W. Schafer, "Digital Processing of Speech Signals", Prentice-Hall, Englewood Cliffs, 1978, chapter 8, pages 396–421). The digital speech signal s(n) is also fed to an adjustable analysing filter 4 having a transfer function A(z) which is given in z-transform notation by:

$$A(z) = 1 - \sum_{i=1}^{i=p} (a(i)*z^{-i})$$

in which the coefficients a(i), where 1=<i=<p, are the LPC parameters calculated in the LPC analyser 5, the LPC order p normally having a value between 8 and 16. The LPC parameter a(i) is determined in a manner such that, at the output of filter 4, a prediction residual signal rp(n) appears having as flat as possible a segment period (20 ms) of the spectral envelope. Filter 4 is therefore known as an inverse filter or a compensating filter. The LPC parameters are transmitted via channel 30 to the receiver 29. Furthermore, the prediction residual signal rp(n) is filtered by the weighting filter 6. The object of said weighting filter is to perceptually weight the prediction residual signal rp(n). Backgrounds and examples are given in EP-195,487. This results in the weighted prediction residual signal rpw(n) denoted above as first pulse signal. The weighted prediction residual signal rpw(n) is fed to the second conversion device 8. Said device 8 splits up the weighted prediction residual signal rpw(n) into four adjoining subsegment signals ss(i,m) for which it holds true that:

ss(i,m)=rpw(m+i*160/4), where i denotes the subsegment number, i=0 . . . 3 and m=1 . . . 40. Each subsegment signal therefore has a duration of 20 ms/4=5 ms. Furthermore, said device 8 splits up each subsegment signal ss(i,m) into 4 subpulse signals dp(j,i,r) (denoted above as second pulse signals) for which it holds true that:

dp(j,i,m)=ss(i,m) for m=j,j+4,j+8,j+12 . . . j+36 and dp(j,i,m)=0 for all other possible values of m, where j denotes the subsignal number j, j=1 . . . 4 and m=1 . . . 40.

All the subsequent components of the transmitter 19 work on a subsegment (5 ms) basis so that the subpulse signal dp(j,i,m) can be abbreviated to dp(j,m). The first selector 9 selects 1 of the 4 subpulse signals dp(j,m) on the basis of the segmental energy. The following applies for the segmental energy Eseg(j) of the subpulse signal dp(j,m):

$$Eseg(j) = \sum_{m=1}^{m=40} (dp(j, m)^2)$$

In this connection, the selected subpulse signal dps(m) is set equal to dp(j,m) and the selection value J (denoted above as first control code) is set equal to j for that value of j for which it holds true that the segmental energy Eseg(j) is greatest. Said method is also described in the CEPT/CCH/GSM recommendation 06.10. The selection value J is transmitted via channel 30 to the receiver 29. The transmitter 19 has a codebook 13. Said codebook 13 is made up of 256 codebook rows. Each codebook row is filled with 10 arbitrary numbers, of which the probability distribution of the values of the numbers is distributed in a Gaussian manner. The second selector 10 selects sequential codebook row 1 to row 256 inclusive from the codebook 13. Every time a codebook row is selected from the codebook 13, this row of 10 numbers will be delivered to the excitation generator 14. The excitation generator 14 generates 10 pulses p(r), where r=1 . . . 10 and where the amplitudes of the 10 pulses assume the value of the row of 10 numbers just received from the codebook 13. On the basis of the selection value J originating from the first selector 9, pulses having amplitude zero (i.e. pulse intervals each of amplitude zero) are added to the 10 pulses p(r). For the new excitation generator pulse series eg(m) (denoted above as set of third pulse signals) it holds true that: eg(J+(r−1)*4)=p(r), where r=1 . . . 10, J=1 or 2 or 3 or 4 and eg(m)=0 for all other cases, where m=1 . . . 40.

The amplifier 12 has an initial gain factor of V=1. The excitation generator signal eg(m) is presented together with the selected subpulse signal dps(m) to the scaling device 11 via the amplifier 12. The scaling device 11 now adjusts the gain factor V of the amplifier 12 in a manner such that the degree of error fm is a minimum, it holding true for fm that:

$$fm = \sum_{m=1}^{m=40} (dps(m) - (V*eg(m)))^2$$

The minimum degree of error is denoted by fmmin. The gain factor occurring at the same time is denoted by the optimum gain factor Vopt (denoted above as the scaling factor (=third control code), so that it holds true for the minimum degree of error fmmin that:

$$fmmin = \sum_{m=1}^{m=40} (dps(m) - (Vopt*eg(m)))^2$$

The values of the minimum degree of error fmmin are transmitted to the second selector 10. The above process is carried out for every codebook row (r=1 . . . 256), with the result that 256 minimum degrees of error fmmin(R) are calculated. From these 256 minimum degrees of error fmmin(R), the smallest value is sought. The associated value of the codebook row R, denoted by selected codbook row Rs (denoted above as second control code), and the optimum gain factor Vopt are transmitted to the receiver via channel 30. These values are transmitted for every 5 ms subsegment. This method attempts to make the amplified excitation generator signal Vopt*eg(m) match the subpulse signal dps(m) as well as possible.

The receiver 29 (FIGS. 1 and 3) contains a Restricted Search Code Excited Linear Predictive decoder (RSCELP decoder) 27. The receiver 29 comprises, inter alia, a codebook 20, excitation generator 21 and amplifier 22 which are exactly identical to codebook 13, excitation generator 12 and amplifier 11 of the transmitter 19. With the aid of the values, received by the receiver 29, of the selected codebook row Rs, the optimum gain factor Vopt and selection value J, the value, which may be called a further residual signal calculated in the transmitter 19, for the amplified excitation generator signal Vopt*eg(m) can be calculated in the receiver 29 with the aid of the codebook 20 and excitation generator 21 and amplifier 22. This further residual signal may also be referred to as a deconversion output pulse signal po(m). The deconversion output pulse signal po(m) therefore matches the selected subpulse signal dps(m) in the transmitter 19 as well as possible. The deconversion output pulse signal po(m) is presented to the LPC synthesizing filter 23. The LPC synthesizing filter 23 is the inverse filter of the LPC analysing filter 4 in the transmitter 19. The transfer function, noted in the z-transform notation, of the LPC synthesizing filter 23 is therefore equal to:

$A(z)^{-1}$.

The synthesizing filter 23 is adjusted for each segment (20 ms) with the aid of the LPC parameter received. The receiver pulse signal po(m) is calculated every 5 ms, with the result that after every fourth receiver pulse signal po(m) which is presented to the synthesizing filter 23, the LPC filter parameters are readjusted. The synthesizing filter output signal is converted, by means of a digital/analog converter 24 and a low pass filter 25 into an analog speech signal which can be made audible by means of an electroacoustic transducer.

To transmit the diverse signals between transmitter 19 and receiver 29 via channel 30 in this exemplary embodiment, 5300 bits per second are necessary. This can be calculated as follows:

The following are transmitted every 5 ms:

| | |
|---|---|
| optimum gain factor Vopt, requirement | 6 bits |
| selected codebook row Rs, requirement | 8 bits |
| selection value J, requirement | 2 bits |
| Total requirement every 5 ms | 16 bits (=3200 bits/s) |

The following is transmitted every 20 ms:

| | |
|---|---|
| LPC parameters, requirement | 42 bits (=2100 bits/s) |

3200+2100=5300 bits are therefore transmitted every second.

I claim:

1. Apparatus for converting a residual signal, which is derived from a digital speech signal by passing sequences, each consisting of the same plural number of digital speech signal samples obtained at time intervals which are equal from one sample to the next, sequence by sequence through filter means controlled by parameters obtained by subjecting each said digital speech signal sample sequence to linear predictive coding, into control code signals for transmission over a transmission medium along with said parameters, said apparatus comprising segmentation means for splitting each residual signal produced from a said sample sequence into segments and for generating per segment several first pulse train signals each one of which comprises a fixed number of pulses at time intervals which are equal from one to the next, each one of said several first pulse train signals starting at a difference starting time position within the respective segment, and comprising selection means for selecting a first pulse train signal most related to a corresponding segment of said residual signal, characterized in that said apparatus further comprises memory means for storing available second pulse train signals, comparing means for comparing a selected first pulse train signal with stored second pulse train signals and for selecting a selected second pulse train signal that exhibits the most correspondence to the selected first pulse train signal, pulses of said second pulse train signals succeeding each other, for comparison in said comprising means at time intervals which are equal from one pulse to the next pulse of said second pulse train signal, and also means for producing each said control code signal from the address, in said memory means, of said selected second pulse train signal and from the time position, within a said segment, of said selected first pulse train signal.

2. Apparatus as claimed in claim 1, characterized in that said apparatus further comprises scaling means for calculating per segment a scaling factor for said selected second pulse train signal, said scaling factor being a further control code signal for transmission over said transmission medium along with said parameters.

3. The apparatus of claim 2, wherein a weighting filter is interposed between said filter means and said segmentation means.

4. The apparatus of claim 1, wherein a weighting filter is interposed between said filter means and said segmentation means.

5. Apparatus for decoding linear predictive coding (LPC) parameters and control code signals related thereto and including at least a signal representative of starting time position of a selected first pulse train signal of pulses at equal time intervals from one pulse to the next and an address signal designating a memory location of a selected second pulse train signal, said apparatus comprising means for receiving said parameters and said control code signals from a transmission medium, means for generating a reconstituted residual signal from said control code signals, and synthesizing filter means for receiving said reconstituted residual signal and said parameters and producing therefrom an output digital signal, characterized in that said apparatus further comprises memory means for storing, at predetermined memory addresses, second pulse train signals which are identical to respective second pulse train signals that correspond to a certain set of said control code signals and means for selecting, from said memory means, said selected second pulse train signal read out with pulses thereof at equal time intervals from one pulse to the next in response to said control code signal which is an address signal, and means for modifying said selected second pulse train signal without affecting said equal time intervals by said control code signal which is a signal representative of starting time position, to produce said reconstituted residual signal.

6. Apparatus as claimed in claim 5, characterized in that said control code signals received by said means for receiving include a scaling factor signal and said apparatus comprises amplifier means for amplifying said received residual signal produced by said signal modifying means by said scaling factor for supply of said received residual signal at a suitable amplitude to said synthesizing filter means.

7. A coder of the linear predictive type for coding digital speech signals having a uniform sample rate and presented to the coder in sequences of the same plural number of digital samples for processing sequence by sequence, comprising a first processing device composed of:

a linear prediction analyzer having an input at which said sequences of digital samples are presented and an output for a linear prediction parameter signal produced by said linear prediction analyzer, filter means controlled through a control input thereof connected to said output of said linear prediction analyzer and having a signal input to which said sequences of digital samples are presented for first producing a residual signal and then, without further control from said control input, producing a first pulse train signal of pulses succeeding each other at equal time intervals from one pulse to the next, said output of said linear prediction analyzer being also connected to a first output of the coder and a second processing device comprising:

means for subdividing said first pulse train signal corresponding to each said sequence of digital samples into a plurality of segments of equal duration without affecting said equal time intervals and for generating, from each said segment, selected first segment pulse train signals respectively starting at different times within the time interval occupied by the segment from which said first segment pulse train signals are generated, means for selecting per segment one of said first segment pulse train signals most related to said first pulse train signal;

memory means for storing a multiplicity of available second segment pulse train signals, having an output;

comparing means for selecting one of said second segment pulse train signals which exhibits the most correspondence, among said stored second segment pulse train signals read out from said memory means at time intervals which are equal from one pulse read out to the next, to said selected first segment pulse train signals, and means for providing second and third outputs of said coder respectively for signals designating, per segment, the starting time of said selected first segment pulse train signal and an address location corresponding to the location of said selected second segment pulse train signal in said memory means.

8. The combination of the coder of claim 7 with:

transmission channel means connected to said first, second and third outputs of said coder for transmitting over a transmission channel said linear prediction parameter signal, said signal designating, per segment, the starting time of said selected first segment pulse train signal and said signal designating, per segment, an address location corresponding to the location of said selected second pulse train signal in said memory means, and a decoder, connected to said transmission channel means at a location other than the location of said coder, comprising:

second memory means substantially identical to said memory means of said coder for storing said multiplicity of available second segment pulse train signals, said second memory means being connected for being addressed by said signal designating an address location, as received from said transmission channel means and reading out, in response to said address signal, a stored second segment pulse train signal in pulses at equal time intervals from one pulse to the next, and having an output for a second segment pulse train signal;

excitation generator means for modifying said second segment pulse train signals without affecting said equal time intervals, having a first input connected to said output of said second memory means and a second input connected to said transmission channel means for receiving said signal (J) designating a starting time of a selected first segment pulse train signal and having an output for modified second segment pulse train signals, and synthesizing filter means having a first input connected for receiving modified second segment pulse train signals from said excitation generator means, a second input serving as a filter-control input connected to said transmission channel means for receiving said linear predictive coding parameter signal, and having an output for supply of a decoded digital speech signal.

9. The combination of claim 8, wherein said sequences of digital samples are presented for processing, sequence by sequence, at a rate per second which is substantially a local alternating current electric power frequency.

10. The combination of claim 8, wherein said comparing means of said coder for selecting one of said second segment pulse train signals has an output connected to said memory means of said coder for interrogating said memory means of said coder and wherein there are interposed, between said output of said memory means of said coder and an input of said comparing means for selecting one of said second segment pulse train signals, the following:

excitation generator means having a first input connected to said output of said memory means of said coder and having a second input connected to said second output of said coder at which there are provided signals designating, per segment, the starting time of said selected first segment pulse train signal for producing at an output of said excitation generator means, per segment, selected second segment pulse train signals which are modified without affecting said equal time intervals;

a first controlled amplifier for controlling the amplitude of said modified second segment pulse train signals, a scaling device having a first input connected to said output of said controlled amplifier, a second input connected to said means for generating selected first segment pulse train signals, a first output connected for controlling the amplification of said first controlled amplifier, a second output which serves as a fourth output of said coder for supplying a scaling factor signal and a third output for supplying, per segment, said modified second segment pulse train signals, and wherein said decoder comprises, interposed between the output of said excitation generator means and said first input of said synthesizing filter means:

a second controlled amplifier having a control input connected for receiving said scaling factor signal from said fourth output of said coder over said transmission channel and having an output connected to said first input of said synthesizing filter.

11. The coder of claim 7, wherein said sequences of digital samples are presented for processing, sequence by sequence, at a rate per second which is substantially a local alternating current electric power frequency.

12. The coder of claim 7, wherein said comparing means for selecting one of said second segment pulse train signals has an output connected to said memory means for interrogating said memory means and wherein there are interposed between said output of said memory means and an input of said comparing means for selecting one of said second segment pulse train signals, the following:

excitation generator means, having a first input connected to said output of said memory means and having a second input connected to said second output of said coder at which there are provided signals designating, per segment, the starting time of said selected first segment pulse train signal, for producing at an output of said excitation generator means, per segment, selected second segment pulse train signals that are modified without affecting said equal time intervals;

a controlled amplifier for controlling the amplitude of said modified second segment pulse train signals, a scaling device, having a first input connected to said output of said controlled amplifier, a second input connected to said means for generating said selected first segment pulse train signals, a first output for controlling the amplification of said controlled amplifier, a second output, which serves as a fourth output of said coder, for supplying a scaling factor signal and a third output for supplying, per segment, said modified second segment pulse train signals to said comparing means, without affecting said equal time intervals of each said second segment pulse train signal, for selecting one of said second segment pulse train signals.

13. A decoder for digital speech signals encoded in a linear-predictive manner and comprising a linear predictive coding parameter signal, a selected memory address signal and a signal designating a starting time of a selected first segment pulse train signal, comprising:

memory means for storing a multiplicity of available second segment pulse train signals, said memory means being connected for being addressed by said selected memory address signal and having a second segment pulse train signal output for reading out pulses of a stored second segment pulse train signal at equal time intervals from one pulse to the next;

excitation generator means for modifying second segment pulse train signals without affecting said equal time intervals, having a first input connected to said output of said memory means and a second input connected for receiving said signal designating a starting time of a selected first segment pulse train signal and having an output for modified second segment pulse train signals, and synthesizing filter means having a first input connected for receiving said modified second segment pulse train signals, a second input serving as a filter control input connected for receiving said linear predictive coding parameter signal, and having an output for supply of a decoded digital speech signal.

14. The decoder of claim 13 wherein a controlled amplifier is interposed between the output of said excitation generator means and said first input of said synthesizing filter means, said amplifier having a control input connected for receiving a scaling factor signal from the location from which said linear predictive coding parameter signal is received.

* * * * *

UNITED STATES PATENT AND TRADEMARK OFFICE

CERTIFICATE OF CORRECTION

PATENT NO. :5,299,281
DATED :March 29, 1994
INVENTOR(S) :Coolegem

It is certified that error appears in the above-indentified patent and that said Letters Patent is hereby corrected as shown below:

Column 6, line 57, "The" should start a new paragraph.

Column 9, line 63 (claim 1)

"comprising" should be --comparing--

Signed and Sealed this

Twenty-sixth Day of March, 1996

*Attest:*

*Attesting Officer*

BRUCE LEHMAN

*Commissioner of Patents and Trademarks*